United States Patent [19]

Porter

[11] 4,289,457

[45] Sep. 15, 1981

[54] COMBINATION SEA VALVE AND DEBALLAST PUMP

[76] Inventor: Carl W. Porter, 315 N. Virginia Ave., Falls Church, Va. 22046

[21] Appl. No.: 62,093

[22] Filed: Jul. 30, 1979

[51] Int. Cl.[3] ..... F04D 27/00

[52] U.S. Cl. ..... 417/424; 415/157

[58] Field of Search ..... 417/360, 423 R, 424; 415/148, 149 R, 157

[56] References Cited

U.S. PATENT DOCUMENTS

| | | | |
|---|---|---|---|
| 628,635 | 7/1899 | Russell et al. | 415/157 |
| 1,656,006 | 1/1928 | Lieber | 415/157 X |
| 1,656,012 | 1/1928 | Nagler | 415/157 |
| 1,703,081 | 2/1929 | Moody | 415/157 X |
| 2,153,576 | 4/1939 | Kurth et al. | 415/157 X |
| 2,430,225 | 11/1947 | Hagler | 415/157 X |
| 3,721,504 | 3/1973 | Crisafulli | 417/424 X |
| 3,963,381 | 6/1976 | Kohnen | 415/157 X |

*Primary Examiner*—Christopher K. Moore

*Attorney, Agent, or Firm*—R. S. Sciascia; Sol Sheinbein; T. Lewis

[57] ABSTRACT

A combination valve and pump assembly for use as ballasting apparatus in ships includes a cylindrical valve element disposed within an opening in a ballast chamber. The valve element communicates with ambient sea water and is movable toward and away from the ship's outer surface to block and unblock the opening. The valve and pump assembly also comprises pump apparatus, operable with the valve element, and including an impeller rotatably positioned concentrically within the valve element. The invention contemplates simultaneous reciprocatory translation of the valve element and the pump assembly by hydraulic motor apparatus such that opening and closing of the opening by the valve element is effected by the hydraulic apparatus, while a pump motor causes rotation of the impeller when the valve element is displaced from a position where the opening is blocked.

6 Claims, 10 Drawing Figures

COMBINATION SEA VALVE AND DEBALLAST PUMP

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

This invention relates to valves, and more particularly to power-operated valve and pump apparatus for flooding and evacuating sea water from compartments of ships.

Efficient disposal of excess or unwanted water, which leaks or is admitted into waterborne vessels, has historically been a problem of great concern. Sea water can enter a ship's compartments in a "passive" manner, e.g. by leakage or flooding (as disclosed in the U.S. Pat. Nos. 551,473; 706,561; and 1,127,648 to Perkins, Holland and Lake, respectively) or in an "active" manner, e.g., by pumping (as disclosed in the U.S. Pat. Nos. 1,796,200, 3,242,613 to Grieshaver and Schwartz, respectively).

At present the two most widely used methods of water evacuation involve either removal of the water from a compartment by centrifugal pumping, or by sealing a compartment and pumping of compressed air into it to "blow out" the water. There are disadvantages, however, attendant with conventional centrifugal pumping methods which make their use extremely undesirable. These methods require, for example, use of extremely expensive machinery and extensive amounts of interconnecting piping. Related to this is the great loss of energy (power consumption) due to frictional losses in the piping system. And in the "blow out" method, a great amount of non-recoverable heat is generated as a result of the air compression, and the pumped air is heated sufficiently to require extensive insulation of the air pipes. This extra insulation not only increases installation costs, but also adds extra weight and maintenance.

SUMMARY OF THE INVENTION

Accordingly, the present invention provides for a valve and pump assembly disposed in an opening in a floodable compartment of a ship. The valve portion of the assembly is mounted for reciprocatory translation into blocking and unblocking positions and employs remotely powered hydraulic positioners to effect the translatory motion. The pump portion of the assembly is housed within, and concentrically carried by, the assembly valve portion. In one embodiment, the pump portion includes a rotatable impeller connected by a splined shaft arrangement to a reversible source of power for rotatably driving the impeller. Operation involves actuation of the hydraulic positioners to cause displacement of the valve portion relative to the opening from a blocking position to either a partially extended, unblocking position or a fully extended unblocking position (for ballasting or for deballasting, respectively) and then actuation of the impeller power source to cause rotation of the impeller. In this way, when the valve portion is in its ballasting position, rotation of the impeller in a first direction assists the entrance of sea water into the compartment through the opening, and when the valve portion is in its deballasting position, rotation of the impeller in a reversed direction will assist expulsion of the sea water from the compartment through the opening. In a second embodiment, the pump portion includes a rotatable centrifugal impeller connected to a source of power which drives the impeller. Operation of the second embodiment contemplates pumping only for deballasting which effects expulsion of water from the compartment regardless of the direction of rotation of the impeller. When the valve portion is in its ballasting position, the impeller is idle.

OBJECTS OF THE INVENTION

It is therefore an object of this invention to provide an apparatus for moving a fluid through a passageway into or out of a compartment.

Another object of this invention is to provide a device for pumping water into or out of waterborne vessels.

Yet another object of this invention is to provide a simple and compact valve and pump combination assembly for pumping water directly through the hull of a ship or other vessel without the use of extensive piping systems.

Still another object of the invention is to provide a valve assembly including a fluid impeller for moving water into or out of a compartment with the valve partially or fully open.

BRIEF DESCRIPTION OF THE DRAWINGS

Other objects and many of the attendant advantages of this invention will readily be appreciated as the same becomes better understood by reference to the following detailed description when considered in connection with the accompanying drawings in which like reference numerals designate like parts throughout the figures thereof and wherein.

DESCRIPTION OF THE INVENTION

Figure 1:
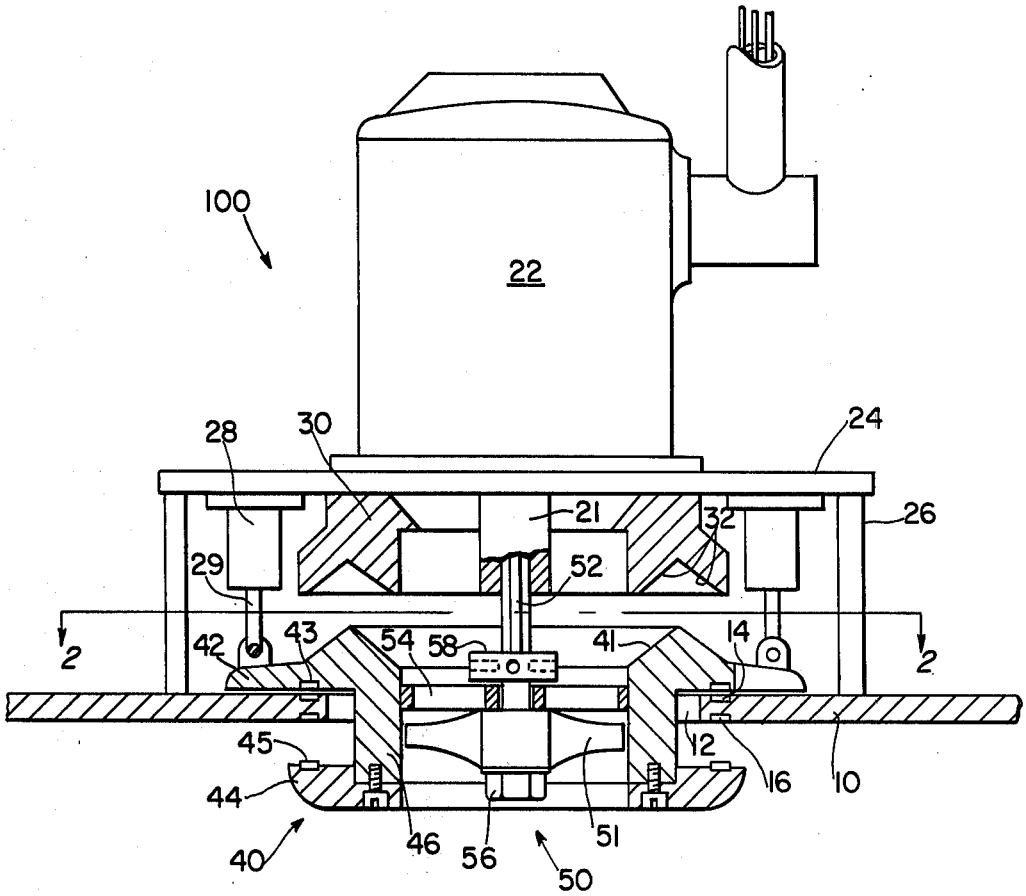
FIG. 1 is a view, partly in section, of a first embodiment of the valve and pump assembly, in a fully open, deballasting position.
Figure 2:
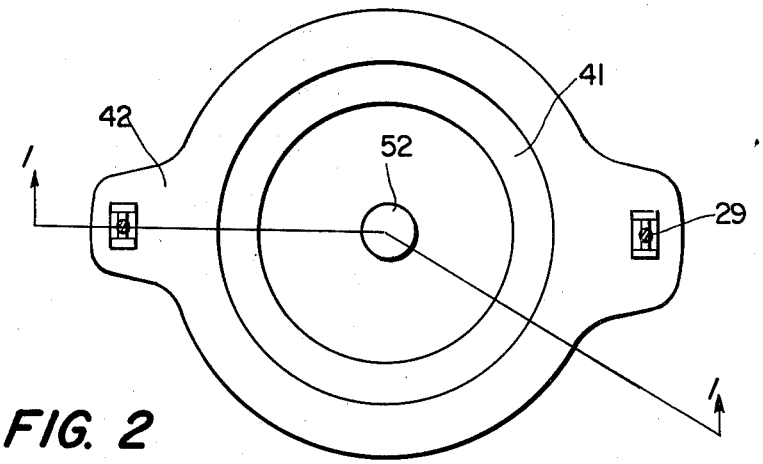
FIG. 2 is a cross-sectional view of FIG. 1 taken along section line 2—2 in FIG. 1.

Referring now to the drawings, wherein like characters and numerals designate like or corresponding parts throughout the several views, there is shown in FIGS. 1 and 2 a combination sea valve and pump assembly 100 mounted in a floodable compartment in a ship partially in an opening 12 in the bottom 10 of the vessel. Assembly 100 comprises reversible motor 22 fastened to platform 24 spaced above the vessel bottom by supports 26 in the compartment, the motor being submersible and including a grooved female shaft 21 extending downwardly therefrom through the platform toward opening 12. Secured to the underside of platform 24 at a location beneath motor 22 and concentrically spaced about shaft 21 is an upper seat 30 for mating receipt of valve element 40. Notched or grooved surface 32 of upper seat 30 cooperates with inboard surface 41 of valve element 40 to form a seal for preventing sea water from entering the compartment when the valve element is raised to its secured position (See FIG. 3). Also attached to platform 24, peripherally spaced from and about motor 22, are a plurality of hydraulic valve positioners 28 which include piston rods 29 attached through pinned connections to valve element 40. Hydraulic valve positioners 28 are disposed vertically between platform 24 and the valve element for causing the latter to translate in a vertical direction toward and away from ship bottom 10. Valve element 40 includes a plurality of inboard ears or flanges 42 with inboard valve seat 43 disposed adjacent the periphery thereof and outboard flange 44 having outboard valve seat 45 disposed peripherally thereabout. Aligned with inboard valve seat 43 and outboard valve seat 45 of the valve element are inboard and outboard valve seats 14 and 16, respectively, disposed on the vessel bottom. These latter valve seats are provided for sealing cooperation with the valve seats of the valve element when the valve element is disposed in its lowered, or raised, position, respectively. Each inboard flange 42 is unitary with annular body portion 46 and overlies not only opening 12 but also outboard flange 44 (See FIG. 2). Body portion 46 of the valve element includes a central bore which forms a cylindrical housing for impeller 51, the impeller being disposed on splined male shaft 52 and captured between nut 56 and bearing collar 54, the latter being a spider fastened to the inside of the valve element bore. Lock collar 58 is fastened above bearing collar 54 on male shaft 52 to prevent the impeller and male shaft from falling through the bore of element 40 into the sea. Using splined male shaft 52 and splined female shaft 21 permits the valve element, and thus the impeller assembly 50 to be raised and lowered in a direction substantially normal to the ship bottom, through use of the hydraulic valve positioners 28 and without the necessity of raising and lowering the motor or its platform.

Figure 3:
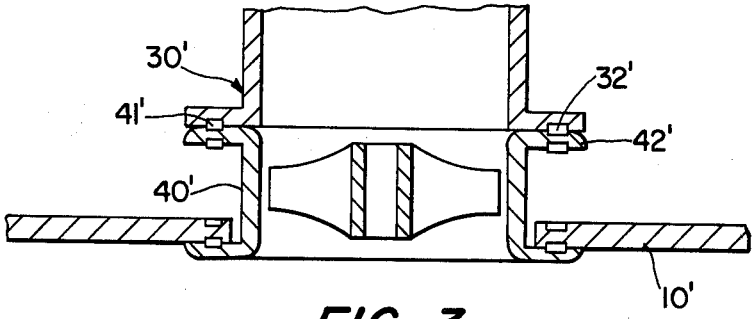
FIGS. 3-5 depict a second embodiment of this invention, and illustrate the three primary operating positions of the valve and pump assembly; closed, partially open (ballasting) and fully open (deballasting), respectively.
Figure 4:
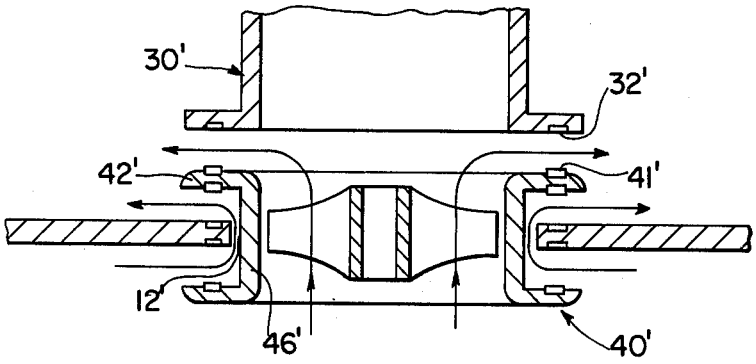
Figure 5:
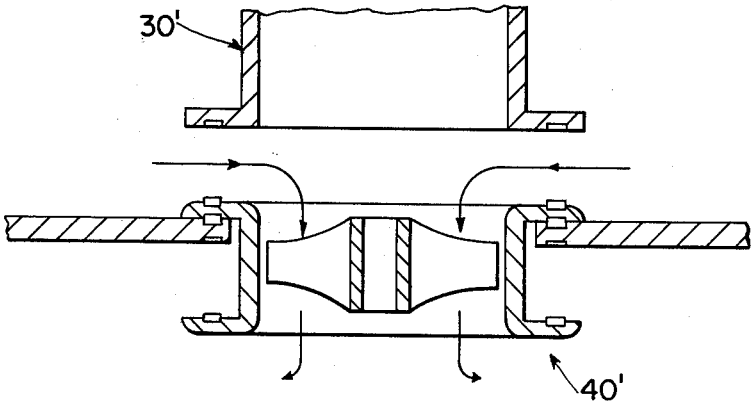

Operation of the valve and pump assembly of FIGS. 1 and 2 is more easily understood by referring to FIGS. 3–5, which schematically illustrate a modification of the FIG. 1 assembly and depict the three key operative positions of both embodiments. The assembly of FIGS. 3–5 differs from that of FIG. 1 by the provision of a modified upper seat 30' and valve element 40', upper seat 30' being attached at its upper end to the platform (24 as shown in FIG. 1 but not shown in FIGS. 3–5) on which the motor is mounted. Upper seat 30' includes valve seat 32' for mating contact with inboard valve seat 41' adjacent flange 42' of valve element 40' (See also FIG. 4).

FIG. 3 illustrates valve element 40' in a secured position relative to the bottom 10' of the ship. In this position, sea water cannot enter the ship through the valve element bore inasmuch as contact between inboard seat 41' of valve element 40' and valve seat 32' of upper seat 30' blocks flow of sea water into the respective compartment.

FIG. 4 shows valve element 40' lowered to an intermediate or ballasting position, wherein sea water enters the ship's floodable compartment by passing not only through the valve element bore, but also through the annular opening 12' between the valve element body portion 46' and the ship's bottom 10'. Inasmuch as the motor is reversible, the impeller can be driven in the opposite direction so that sea water is pumped through the valve embodiment bore and into the ballast compartment.

FIG. 5 illustrates valve element 40' disposed in its lowermost or deballasting position, wherein the only way in which the ambient sea water can enter the ship's ballast compartment is through the valve element bore. However, valve element 40' is disposed in this position only when removal of sea water from the ballast compartment is desired, and removal is effected by operation of the impeller designed so that water is pumped out of the compartment. This is facilitated by choosing the impeller and motor such that the pumping head and capacity is adequate to move the desired amount of sea water out of the compartment against the net static head. This latter quantity is defined by the difference between the static head of the water inside and outside the ship plus the head due to friction of the flow of water through the valve. The net difference in head is least when the ballast tank is fullest, and the ship's draft is greatest. As water is pumped out of a compartment, the ship's weight, including cargo and water in the ballast tanks, will decrease and, as the amount of displaced water is reduced, the ship rises higher in the water. Finally, when the ballast tank is emptied, the amount of static head against which the pump must work is maximized and is directly proportional to the draft of the ship in the region of the tank.

Figure 6:
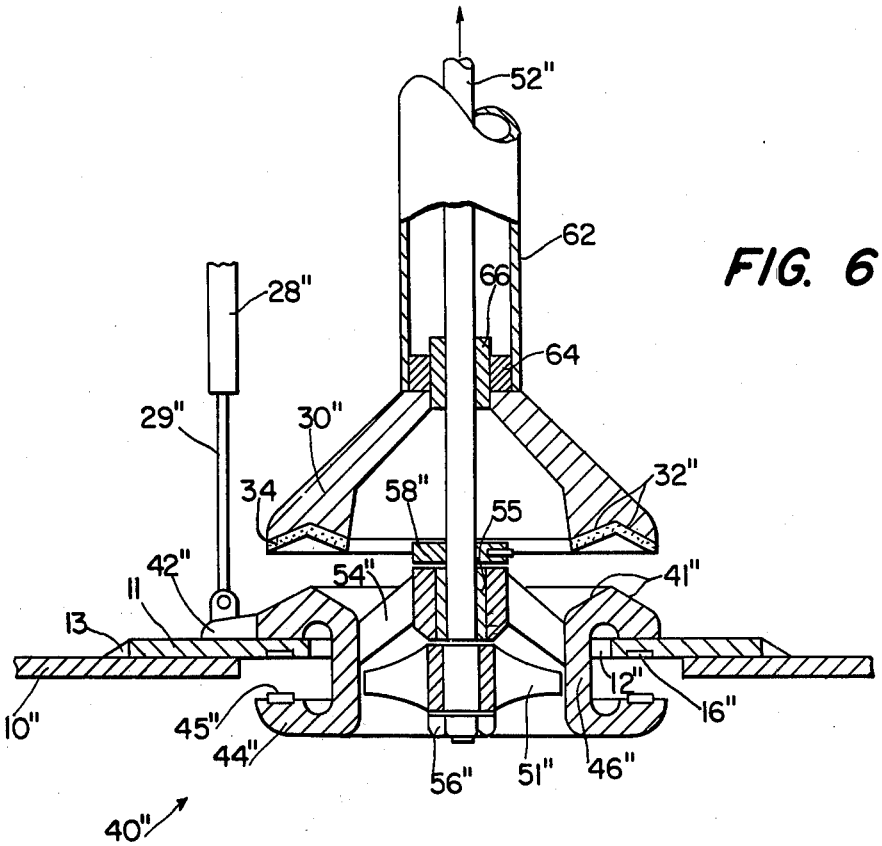
FIG. 6 illustrates a third embodiment of the present invention.

FIG. 6 shows another embodiment of the combination sea valve and pump assembly in which the platform (not shown), reversible motor (not shown) and hydraulic lifters (28'' and 29'') of the pumping assembly are located outside of and above, or at the highest waterline line in, the compartment. The FIG. 6 assembly may include plate 11, shown attached to bottom 10'' inside the compartment through weld 13, the plate functioning as a removable segment of ship bottom 10'' to accommodate installation of valve element 40'' of the valve assembly. Plate 11 is provided with seats 16' which matingly engage seating elements 45'' on the outboard flange 44'' of the valve element. As with the assembly of FIG. 1, the valve assembly of FIG. 6 is mounted for reciprocable translatory movement into and out of blocking relationship with opening 12'' in bottom 10'' of the ship. Dependent from the motor is a splined female shaft (not shown), the shaft being joined with male splined shaft 52'' at an appropriate location beneath the motor. Supported from the motor support framework and extending along a major portion of the length of male shaft 52'' is concentrically encircling watertight stand pipe and shaft casing 62, the lower end of the casing enclosing bearing collar 66 and packing 64. Attached to male shaft 52'' immediately below bearing collar 66 is upper seat 30'' which is concentrically disposed about male shaft 52'', upper seat 30'' optionally including sealing gasket 34 attached to notched or grooved surface 32''. Only shaft 52'', as well as those elements attached thereto, experience translatory movement resulting from application of direct force from the hydraulic lifters. Both valve element 40'' and impeller 51'' are mounted, and supported by the lower end of shaft 52'', in much the same manner as the valve element 40 of the FIG. 1 embodiment. That is, valve element 40'' comprises inboard ears or flanges 42'' adjacent upper seat 41'' (described above), and outboard flange 44'' having an upper seat at 45'' disposed peripherially thereabout receivable in lower seat 16'' of plate 11. Each inboard flange 42'' upper seat 41'', and outboard flange 44'' are unitarily joined by central annular body portion 46'', each upper, and lower, flange being configured to overlie an equal portion of surrounding plate 11, as well as one another. Body portion 46'' of the valve element includes a central bore which forms a cylindrical housing for impeller 51'' disposed on the lowermost end of shaft 52''. Impeller 51'' is captured between nut 56'' and bearing collar 55'' housed in spider 54'' disposed about the collar. Lock collar 58'' is fastened to male shaft 52'' above bearing collar 55'' to prevent impeller 51'' and the male shaft from falling through the bore of valve element 40''.

Figure 7:
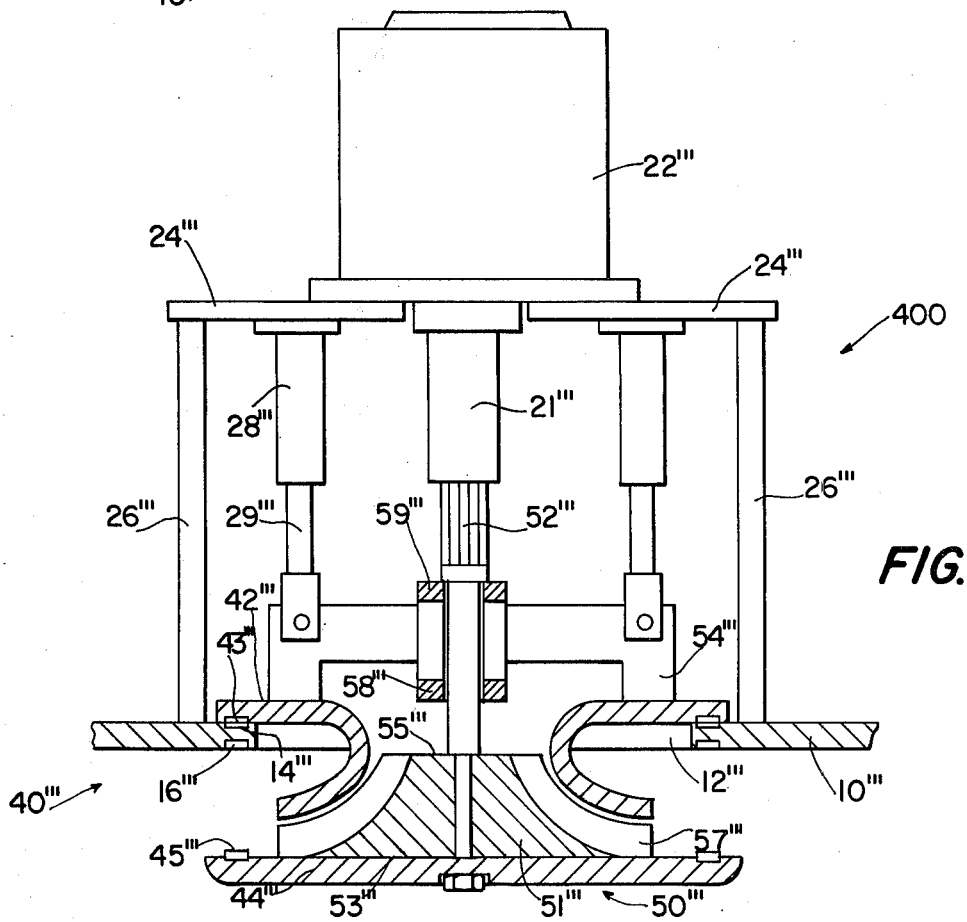
FIG. 7 shows a fourth embodiment of the present invention in its fully open (deballasting) position.
Figure 8:
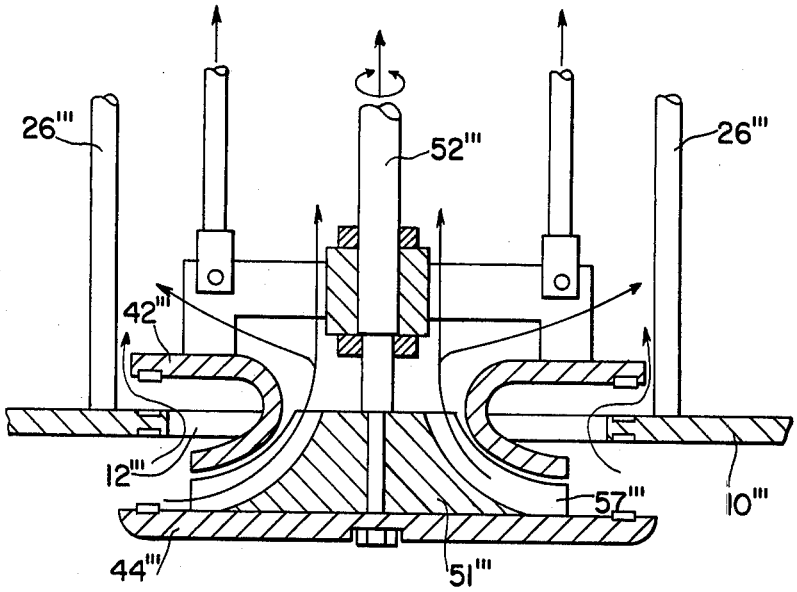
FIGS. 8 and 9 show the valve and pump assembly of FIG. 7 in its partially open (ballasting), and fully closed, position, respectively.
Figure 9:
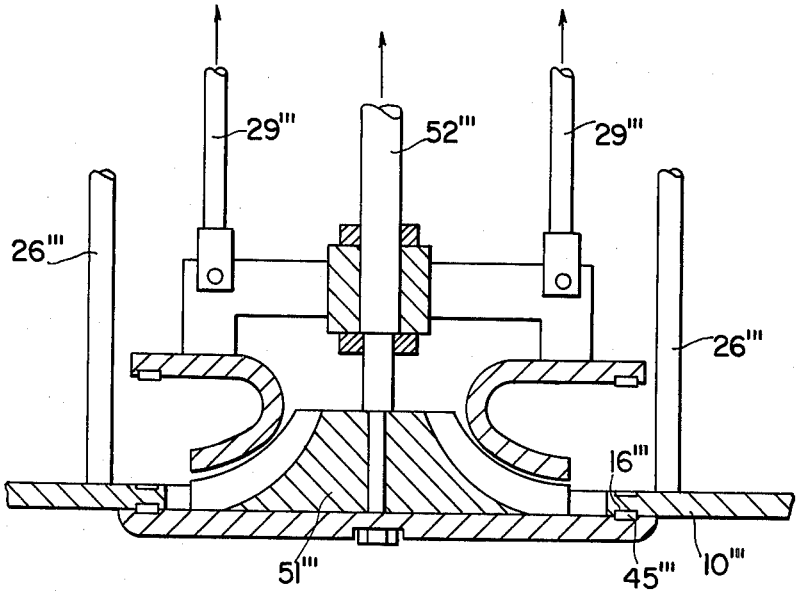

FIGS. 7–9 disclose another embodiment of the present invention in which the valve element includes a two-part housing, the lower part comprising the impeller assembly.

FIG. 7 illustrates valve and pump assembly 400 in its fully open deballasting position. Like the assembly of FIG. 1, assembly 400 is mounted in a floodable compartment in a ship adjacent opening 12''' preferably circular in shape in bottom 10''' of the vessel. Assembly 400 comprises reversible motor 22''' mounted on platform 24''' spaced above the vessel bottom by supports 26''' in the compartment, the motor being submersible and including rotatable grooved, female shaft 21''' extending downwardly therefrom and through the platform 24''' toward opening 12'''. Secured between the underside of platform 24''' and upper impeller casing 42''', and located concentrically about shaft 21''', are a plurality of hydraulic valve positioners 28''' and their respective pistons 29''', each of the pistons, at its lower end, being pinned to upper impeller casing 42''', the impeller casing defining a circle about its outer periphery. The hydraulic valve positioners 28''' and pistons 26''' coact with upper impeller casing 42''' through spider 54''' thereby imparting translatory, nonrotating movement to impeller casing 42''', the latter moving vertically toward and away from ship bottom 10'''. On the surface of upper impeller casing 42''' adjacent opening 12''' in bottom 10''' is outer valve seat 43''', and on the bottom 10''' adjacent opening 12''' are valve seats 14''' (for mating contact with valve seat 43''') and 16''' (for mating contact with valve seat 45''' on the upper surface of impeller lower casing or backplate 44'''). All valve seats mentioned above extend circumferentially about the male shaft and coaction between either seats 43''' and 14''' or seats 45''' and 16''' takes place only upon assembly 400 being fully extended (as shown in FIG. 7) or fully retracted (as shown in FIG. 9), respectively. Like the valve element of assembly 100 of FIG. 1 which includes a central bore forming a cylindrical housing for impeller 50 impeller upper casing 42''' of assembly 400 for FIG. 5 also includes a central bore through which male shaft 52''' extends, the upper end thereof mating with female shaft 21''', the lower end thereof supporting impeller 51''', and the mid-portion of shaft 52''' being vertically positioned within spider 54''' for rotation therein about the vertical axis of the shaft. For this purpose, spider 54''' includes a bearing collar surrounding shaft 52''', and upper and lower shaft collars 59''' and 58''', respectively, for locking the shaft in position relative to the bearing collar as well as for maintaining the appropriate spacing between lower casing 44''', and upper casing 42'''.

Impeller 51''' is substantially trapezoidal as shown in the FIG. 7 cross-sectional view, and includes circular upper and lower surfaces 53''' and 55''', respectively. Positioned about the axis of rotation of the impeller, and extending substantially axially and radially between the upper and lower surfaces, are vanes 57'''. These vanes posses axial curvatures divergent along the body of the impeller relative to the impeller axis of rotation, extending from upper surface 53''' to lower surface 55'''. The vanes are shaped so that, when they are rotated in a predetermined direction, they impel the water axially outwardly from within the ship and toward the radially outermost portion adjacent valve seat 45''' of the impeller. From upper surface 53''' along the body of the impeller to lower surface 55''', vanes 57''' gradually curve radially outwardly so that a generally outward motion is imparted to the water as it is being expelled from the compartment. The direction of exit of the water from the radially outermost portion of the vanes is determined by the curvature of the outermost portion of the vanes. The impeller shown in FIGS. 7–10 possesses what is commonly known as a "mixed flow" design. This invention contemplates use of numerous impeller designs, the use of any one design depending on the exact pumping action or performance desired.

As in assembly 100 disclosed in FIG. 1, the use of splined male shaft 52''' with splined female shaft 21''' permits valve element 40''' of assembly 400, which includes impeller 51''', to be raised and lowered through the use of hydraulic positioners 28''' without the necessity or raising and lowering the motor or the platform.

FIGS. 8 and 9 depict the valve and pump assembly of FIG. 7 in partially open, ballasting position and in fully closed position, respectively. In FIG. 8, sea water enters the ship's floodable compartment by passing not only through vanes 57''' of the impeller but also through the annular opening 12''' between upper impeller casing 42''' and the ship bottom 10'''. FIG. 9 shows the valve and pump assembly in its fully closed position, blocking access of sea water into the ship's floodable compartment. Engagement of valve seats 45''' and 16''' insure prevention of unwanted flow or leakage into the compartment.

Figure 10:
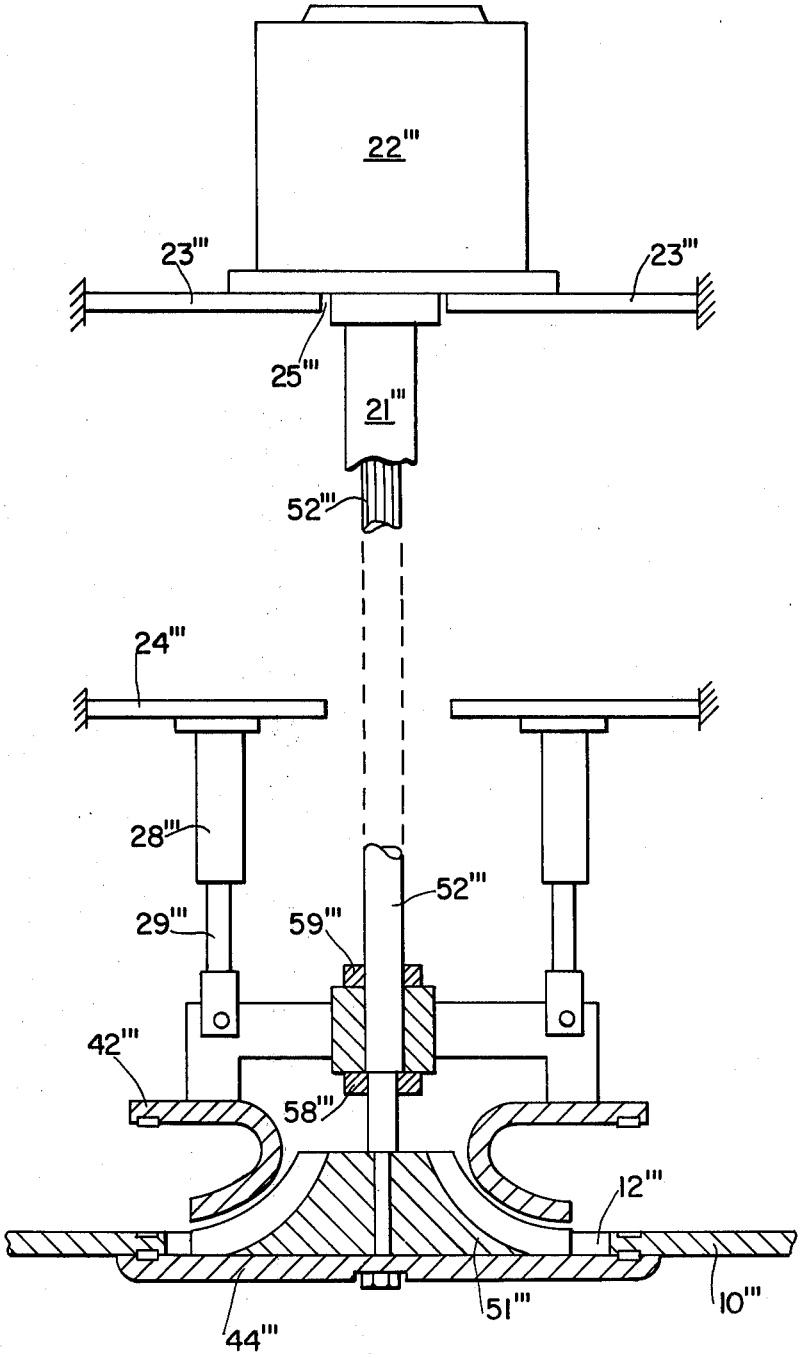
FIG. 10 is a fifth embodiment of the present invention.

FIG. 10 depicts the valve and pump assembly of FIGS. 7–9 where the motor 22''' is not submersible and therefore cannot be located within the floodable compartment. In this arrangement, motor 22''' is usually mounted on a supporting platform 23''' fixed in some conventional manner to the ship structure external to the floodable compartment having centered therein, beneath motor 22''', an opening 25''' through which female splined shaft 21''' extends toward opening 12''' in bottom 10'''. Male splined shaft 52''' is elongated so that it extends through platform 24''', located within the floodable compartment, and interconnects female shaft 21''' with the valve and pump assembly in a splined connection in the same manner set forth in the description for FIG. 7.

There has therefore been described a combined valve and pump assembly for flooding and evacuating a compartment of a ship. The assembly comprises a valve portion located in an opening in the compartment communicating the latter with the sea, and which is remotely actuated to move between a blocking position and at least two unblocking positions. The assembly also comprises an impeller portion carried within the valve portion and actuable when the latter is in any of its unblocking positions to selectively effect the desired flooding or evacuating of the compartment. The valve and pump assembly provides intake into, or explusion from, floodable ship compartments directly through the bottom of the ship, and eliminates the need for any intake or discharge piping. The assembly offers the advantage of conservation of energy required or efficient operation of such equipment by minimizing the loss of power typically attributed to friction in an extensive piping system. Moreover, the weight of deballasting and ballasting equipment, as well as space and cost requirements, is greatly reduced when the present invention is utilized.

Obviously many modifications and variations of the present invention are possible in the light of the above teachings. It is therefore to be understood that, within the scope of the appended claims, the invention may be practiced otherwise than as specifically described.

What is claimed is:

1. An apparatus for selectively controlling the flow of a fluid through a barrier, said barrier including an opening therethrough, said apparatus comprising:

means for blocking said opening;

means for selectively translating a movable portion of said blocking means to at least one operative unblocking position; and means for impelling the fluid through said barrier, said impelling means being carried by said movable portion of said blocking means;

such that when said movable portion thereof is translated to an unblocking position, actuation of said impelling means causes control of the flow of the fluid in a preselected direction through said barrier.

2. The apparatus of claim 1 wherein said barrier further includes upper and lower surfaces, said opening therein extending from said upper surface to said lower surface, and wherein said movable portion of said blocking means is translatively disposed in said opening.

3. The apparatus of claim 1 wherein said blocking means further includes a stationary portion, said stationary portion and said movable portion each including sealing means for coacting with sealing means on said upper and lower surfaces of said barrier for sealing against fluid leaks when said blocking means is in a blocking portion.

4. The apparatus of claim 3 wherein said translating means further includes a piston rod device operatively connected between said stationary portion of said blocking means and said movable portion thereof; said translating means operating to translate said movable portion of said blocking means from a position in which said opening is blocked to first and second positions in which said opening is unblocked; and wherein said impelling means further includes a reversable motor device operatively connected to said blocking means and said impelling means, said impelling means operating to impell the fluid in one direction through said opening at said first unblocked position, and when the rotation of a motor of said reversable motor device is reversed propelling the fluid in a reversed direction through said opening at said second unblocked position.

5. The apparatus of claim 4 wherein said reversable motor device further includes a first splined shaft operatively connected to said motor, and a second splined shaft operatively connected to said movable portion of said blocking means and to said impeller means, said second splined shaft being coaxially connected to said first splined shaft such that translational and rotational motion is imparted to said impelling means.

6. The apparatus of claim 1 wherein said translating means is operatively attached to an upper flange of said movable portion of said blocking means, said upper flange overlying said barrier to provide a lower limit for the movement of said movable portion of said blocking means.

* * * * *